United States Patent [19]

Pfäffle

[11] 4,249,278

[45] Feb. 10, 1981

[54] MACHINE AND METHOD FOR SPIRAL BINDING OF SHEET GROUPS WITH PLASTIC THREAD

[75] Inventor: Ernst Pfäffle, Neuffen, Fed. Rep. of Germany

[73] Assignee: Hans Sickinger Co., Pontiac, Mich.

[21] Appl. No.: 57,448

[22] Filed: Jul. 13, 1979

[51] Int. Cl.[3] ..... B42B 2/00

[52] U.S. Cl. ..... 11/1 A; 425/113; 140/92.3

[58] Field of Search ..... 11/1 R, 1 A; 140/92.3, 140/92.93, 92.94, 92.4; 425/113, 114, 403, 515, 516

[56] References Cited

U.S. PATENT DOCUMENTS

| | | | |
|---|---|---|---|
| 2,638,609 | 5/1953 | Penner | 11/1 A |
| 2,808,079 | 10/1957 | Tauber | 140/92.3 |
| 3,526,692 | 9/1976 | Onaka | 425/516 X |
| 3,940,228 | 2/1976 | Griffin | 425/403 |

*Primary Examiner*—Paul A. Bell

*Attorney, Agent, or Firm*—Harness, Dickey & Pierce

[57] ABSTRACT

A method and machine for feeding plastic thread from a bulk spool, forming the thread into a spiral configuration, and inserting the spiral into a perforated sheet group so that it may be cut and bent to form a spiral binder. The machine and process is continuous and includes a first section in which the thread is softened as it moves around a mandrel, a second section where the formed thread is cooled and a final section at which the coil is fed into a perforated sheet group.

12 Claims, 3 Drawing Figures

1
15
18
12
23
22
62
55
54
56
53
57
1
58
73
72
68
67
74
75
65
66
74

MACHINE AND METHOD FOR SPIRAL BINDING OF SHEET GROUPS WITH PLASTIC THREAD

BACKGROUND OF THE INVENTION

1. Field of the Invention

The invention relates to the spiral binding of perforated sheet groups, and more particularly to the use of plastic thread for the spiral binder.

2. Description of the Prior Art

Plastic spiral binders for sheet groups have certain advantages over metal spiral binders in terms of resistance to damage, particularly in cases where the ends of two binders are accidentally hooked together. In the past, plastic spiral binders have been performed and later inserted in the sheet groups.

A search on the subject matter of this invention revealed the following prior art: The patent to Tauber, U.S. Pat. No. 2,808,079 of Oct. 1, 1957, relates to a book binding machine in which there is a spool of material referred to as wire or some other similar material which is formed into a spiral threaded into the notebook and severed all in one machine. Although this patent does imply that other material might be used, it does not have any heating or cooling arrangement in the structure, and therefore it does not appear that plastic could be formed.

The patent to Penner, U.S. Pat. No. 2,638,609 of May 19, 1953, illustrates a machine for binding books in which plastic coils are used for the binding; however, this machine does not form the coils.

The patent to Griffin, U.S. Pat. No. 3,940,228 of Feb. 24, 1976, was selected as being of general interest as it shows the forming of a coil in plastic material, however, this is on a telephone cord rather than book binding spiral.

BRIEF SUMMARY OF THE INVENTION

It is an object of the invention to provide a novel method and machine for the spiral binding of sheet groups with plastic thread which permits the continuous formation of the binder from a bulk spool plastic thread and insertion of the formed spiral binder into the sheet group without delay so that the binder may be end-cut and bent in a conventional manner.

It is another object to provide an improved machine or method of this character which is relatively simple and easy to construct and is reliable and economical in operation.

Briefly, the method of this invention comprises the steps of taking a plastic thread from a bulk spool in a continuous manner, feeding the thread to a first section where it is heated and at the same time formed into a spiral, continuing to feed the heated thread while maintaining its spiral shape to a second section where the thread is cooled while still holding its shape, and continuing to feed the cooled thread into a perforated sheet group to form a spiral binder, said steps all being carried out in a continuous manner.

The machine of this invention comprises, in combination, a mandrel, a sleeve surrounding said mandrel, a spiral groove formed between said sleeve and mandrel, means feeding bulk plastic thread into said spiral groove at one end of the mandrel, means rotating the mandrel, the mandrel and sleeve extending through a first section and a second section, heating means in the first section, cooling means in the second section, and means at the exit of said second section supporting a perforated sheet group in position to receive a spiral plastic binder from said second section.

DESCRIPTION OF THE PREFERRED EMBODIMENT

Figure 1:
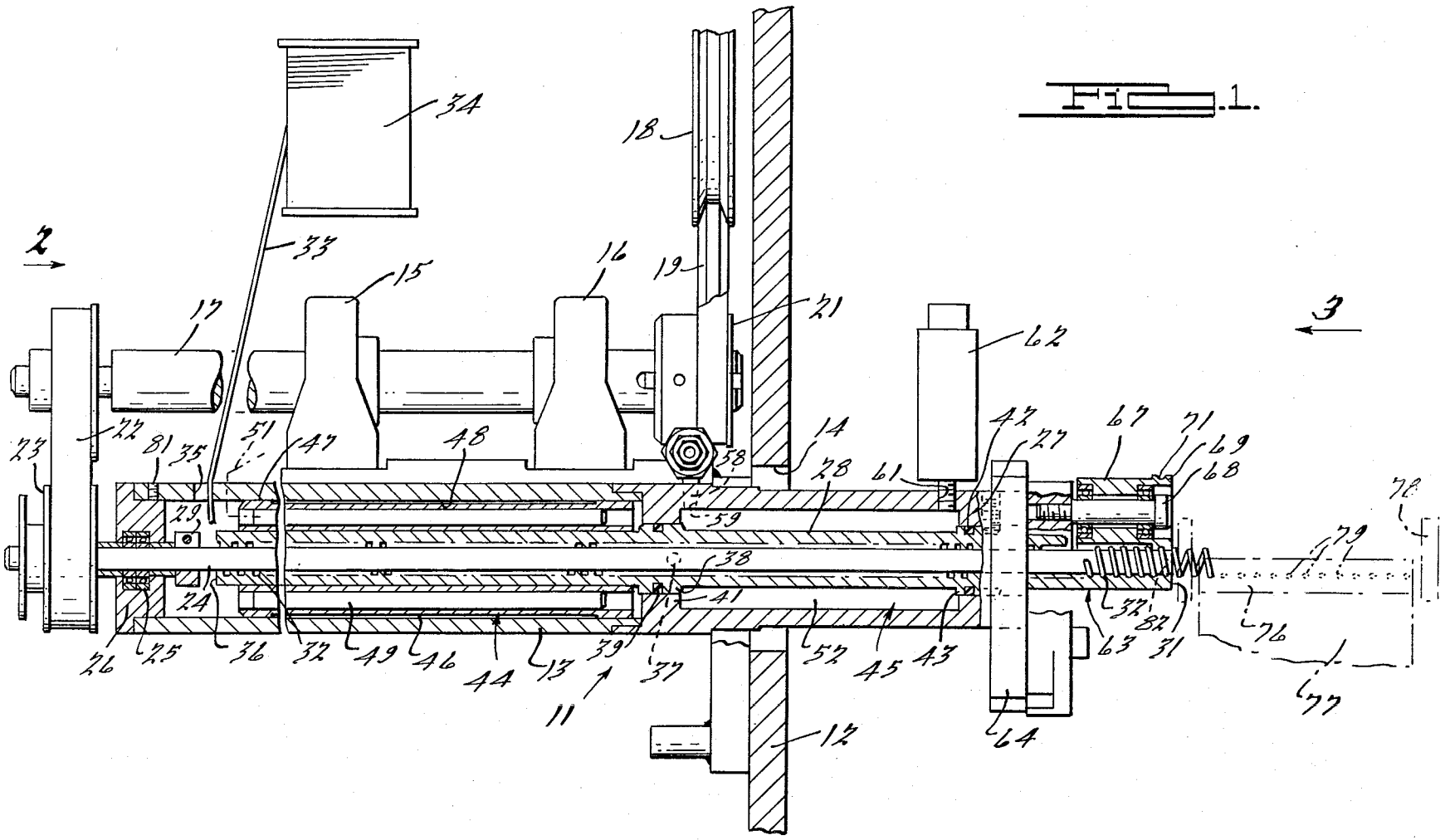
FIG. 1 is a side elevational view in cross section taken along the line 1—1 of FIG. 2 and showing the machine of this invention.

The machine is generally indicated at 11 and has a supporting frame shown partially at 12. The machine includes a housing 13 of cylindrical shape extending through an aperture 14 of frame upright 12. A pair of bearing supports 15 and 16 are mounted on housing 13 and carry a jack shaft 17. This shaft transmits rotary power from a pulley 18 through a belt 19 and a pulley 21 mounted on shaft 17, to a gear belt 22 which drives a pulley 23.

Pulley 23 is secured to a mandrel 24 which extends through housing 13. The diameter of mandrel 24 is substantially equal to the desired inner diameter of the spiral binder to be formed. The mandrel is supported by a bearing 25 in an end cap 26 of housing 13. The discharge end of the mandrel extends through a housing portion 27, and the main portion of mandrel 24 within the housing is supported by a wire forming guide in the form of a sleeve 28. The left hand end of this sleeve is immediately inwardly of a collar 29 inside end cap 26, and the right hand end 31 of the sleeve is outside the housing and ends at approximately the same location as the end of mandrel 24.

Sleeve 28 is provided with a continuous spiral groove 32 from end to the other. The pitch and size of this groove are such as to accommodate a plastic thread 33 which is fed from a bulk spool 34. The thread passes through an access opening 35 in housing 13 adjacent the left hand end 36 of the sleeve and enters groove 32 at this point. A set screw indicated at 37 is carried by housing 13 and holds sleeve 28 against rotation. An enlargement 38 is formed on an intermediate portion of sleeve 28 and carries a seal 39 which coacts with a portion 41 of the housing. A second seal 42 is carried by an enlargement 43 at the right hand end of housing 13, this seal cooperating with end 27 of the housing. These elements form housing 13 into two sections, a first or heating section indicated generally at 44 and a second or cooling section indicated generally at 45.

A heating element housing 46 is located in section 44 surrounding sleeve 28. The ends 47 of housing 46 engage the inside surface of housing 13 while the remainder of housing 46 is spaced inwardly from housing 13 to provide an insulating space 48. A plurality of circumferentially spaced heating elements 49, such as those commonly referred to as "pencil heaters," are provided in housing 46. These elements extend substantially along the entire length of housing 46 and are supplied with heating current from a source indicated partially and schematically at 51. The heat control means is such as to maintain the slotted portions 32 of sleeve 28 in section 44 at a sufficiently high temperature during operation as to soften the plastic thread 33 passing therethrough as mandrel 24 rotates. This will cause the plastic thread to become softened sufficiently to be formed into the desired coil shape. The heat control means is such as to prevent the heat from exceeding permissible limits which might permit undesirable stretching of the plastic thread.

A cooling chamber 52 surrounds sleeve 28 within cooling section 45 so that the softened and formed plastic thread passing through section 45 will become fixed in its coiled shape. In the illustrated embodiment of the invention, the cooling means comprises a vortex tube generally indicated at 53 which supplies cooled air in a known manner to chamber 52. The vortex tube is described for example in a publication of Vortec Corp., Cincinnati, Ohio, entitled "A Short Course on Vortex Tube and Application Notes." Basically, the vortex tube operates on the principle of supplying high pressure air at an inlet 54, the air entering a vortex generation chamber 55 from where it enters a hot tube 56. An adjustable control valve 57 is placed at the outer end of this hot tube, this end being referred to as the "hot outlet." A cold outlet is indicated at 58 and this outlet is connected to a port 59 at the entrance end of chamber 52. The cold air thus cools the sleeve 28 in chamber 52, and will exit at a port 61 to a muffler 62.

Figures 2, 3:
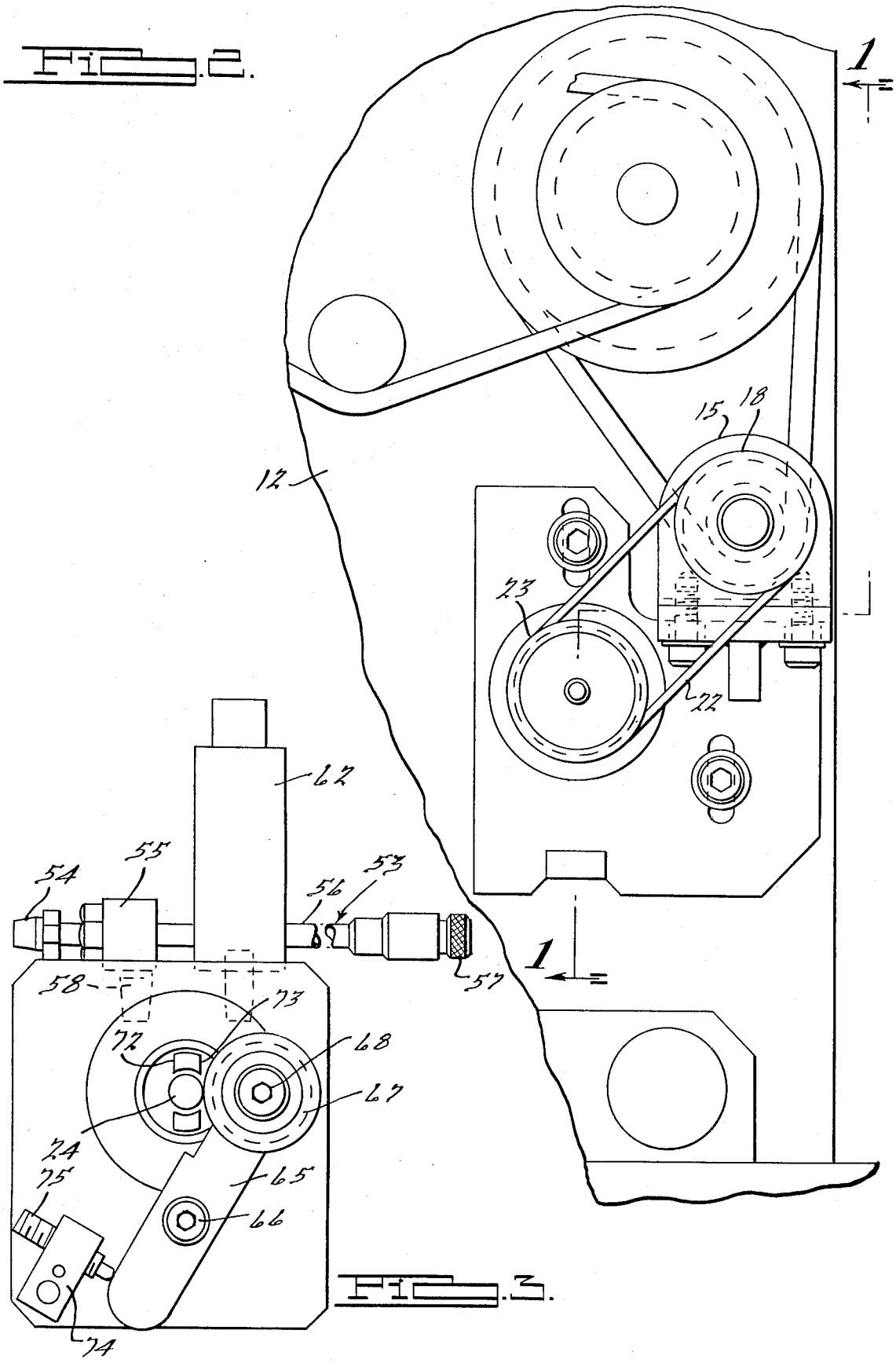
FIG. 2 is an end elevational view taken in the direction of the arrow "2" of FIG. 1.
FIG. 3 is an end elevational view taken in the direction of the arrow "3" of FIG. 1.

A driving section of mandrel 24 and sleeve 28, generally indicated at 63, extends outwardly past the end 27 of housing 13. A mounting plate 64 is secured to end 27 of housing 13 and carries a tension arm 65 which is pivoted thereto at 66. The upper end of this arm carries a roller 67 by means of a pivotal support 68. Roller 67 has an enlarged portion 69 at the exit end of section 63 which is provided with a groove 71 adapted to engage the plastic thread on mandrel 24. The remaining portion of roller 67 is relieved. Sleeve 28 in the vicinity of roller 67 has two cut-out portions, the first portion being indicated at 72 in FIG. 3 and the second portion indicated at 73. Cut-out portion 72 permits the operator to view the plastic thread on mandrel 24 whereas cut-out portion 73 permits access to the mandrel by roller 67. A block 74 is secured to mounting plate 64 at the lower portion thereof and carries a spring plunger 75 which is threadably mounted thereon. This plunger engages the lower end of tension arm 65 so that by adjusting member 75 the pressure of roller 67 on the plastic thread may be varied. This will in turn adjust the tension which the rotatably driven mandrel 24 exerts on the plastic thread being fed therealong.

Means indicated schematically at 76 are provided for holding a perforated sheet group 77 in position for receiving the spiral wire binder. Adjacent means 76 are means indicated schematically at 78 for cutting and inwardly bending the ends of the spiral binder after it has passed through the perforations 79 of the sheet group. The holding, cutting and bending means may all be of conventional construction such as those shown in U.S. Pat. No. Re. 26,929 issued June 30, 1970. This means will of course be aligned with the exit of section 63.

In operation, machine 11 will be set up by initially threading plastic thread 33 through slot 32 and around mandrel 24. This is done by removing end cap 26 which is held in place by a set screw 81 and withdrawing mandrel 24 to the left. An aperture 82 is provided in the exit end of mandrel 24 into which the forward end of thread 33 may be threaded. The mandrel is then reinserted in sleeve 28 and rotated so that the plastic thread will be fed entirely through slot 32. End cap 36 is then replaced, and the end of thread 33 passing through aperture 82 cut off.

When operating the unit, a sheet group 77 will be held by clamping means 76 and mandrel 24 will be continuously rotated with heating means 49 being energized and the cooling chamber 52 filled with cooling air. The plastic thread 33 being drawn off bulk spool 34 will be fed through the heating chamber where it will be softened and permitted to assume the shape controlled by slot 32 and mandrel 24. The softened coil will then pass through cooling section 45 where it will be set in its formed shape. It will then be fed continuously through driving section 33 where roller 67, being held against mandrel 24, will create tension on the coil so that it may be driven outwardly into apertures 79 of the sheet group. When the coil has been fed entirely through the apertures, the rotation of mandrel 24 will be stopped and cutting and bending mechanism 78 will trim cut and inwardly bend the coil ends to form the completed spiral binders. Sheet group 77 will then be removed by the next sheet group, and the action will be repeated.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. A method comprising the steps of taking a plastic thread from a bulk spool in a continuous manner, feeding the thread to a first section where it is heated and at the same time formed into a spiral, continuing to feed the heated thread while maintaining its spiral shape to a second section where the thread is cooled while still holding its shape, and continuing to feed the cooled thread into a perforated sheet group to form a spiral binder, said steps all being carried out in a continuous manner.

2. In combination, a mandrel, a sleeve surrounding said mandrel, a spiral groove formed between said sleeve and mandrel, means feeding bulk plastic thread into said spiral groove at one end of the mandrel, means rotating the mandrel, the mandrel and sleeve extending through a first section and a second section, heating means in the first section, cooling means in the second section, and means at the exit of said second section supporting a perforated sheet group in position to receive a spiral plastic binder from said second section.

3. The combination according to claim 2, further provided with a seal between said two sections.

4. The combination according to claim 3, further provided with a housing surrounding said sleeve, said seal being formed between an intermediate portion of said sleeve and said housing.

5. The combination according to claims 2 or 3, said first section comprising heating means surrounding said sleeve.

6. The combination according to claim 5, said second section comprising a chamber surrounding said sleeve and means for introducing a cooling agent in said chamber.

7. The combination according to claim 6, said means for introducing a cooling agent comprising an air vortex type unit connected to said chamber.

8. The combination according to claim 2, said spiral groove being formed in said sleeve.

9. The combination according to claims 2 or 8, further provided with a roller mounted adjacent the exit end of said sleeve and engageable with said mandrel.

10. The combination according to claim 9, said sleeve having a cut-out portion for access by said roller to said mandrel, the roller having a groove engageable with the spiral plastic binder.

11. The combination according to claim 10, further provided with means for adjusting the pressure of said roller against said mandrel.

12. The combination according to claim 11, said last mentioned means comprising a lever on which said roller is mounted and means for adjusting the position of said lever.

* * * * *